US005277210A

United States Patent [19]

Kim

[11] Patent Number: 5,277,210

[45] Date of Patent: Jan. 11, 1994

[54] DRYING DUCT OF DISHWASHER

[75] Inventor: Shin-Yong Kim, Suwon, Rep. of Korea

[73] Assignee: Samsung Electronics Co., Ltd., Suwon, Rep. of Korea

[21] Appl. No.: 888,590

[22] Filed: May 27, 1992

[30] Foreign Application Priority Data

May 27, 1991 [KR] Rep. of Korea ..... 91-8681

[51] Int. Cl.[5] ..... A47L 15/48

[52] U.S. Cl. ..... 134/95.2; 34/76; 34/133 A; 55/269; 134/107; 134/182; 134/201

[58] Field of Search ..... 134/95.2, 107, 182, 134/200, 201; 68/20; 34/73, 76, 133 A; 235; 55/80, 267, 269; 312/213

[56] References Cited

U.S. PATENT DOCUMENTS 1,777,493 10/1930 Jadin et al. ..... 34/73
2,301,601 11/1942 Wittwer et al. ..... 134/200 X
5,056,543 10/1991 Dygve ..... 134/107

FOREIGN PATENT DOCUMENTS 57-112765 12/1982 Japan .

*Primary Examiner*—Philip R. Coe
*Attorney, Agent, or Firm*—Burns, Doane, Swecker & Mathis

[57] ABSTRACT

A flexible air duct is connected to a dishwashing unit for conducting hot moist air therefrom. Opposite ends of the duct communicate with the dishwashing unit for conducting condensed water back thereto, while hot air is discharged through an air outlet disposed intermediate the ends of the duct. The duct is of oblong cross-section and includes cooling fins on one side.

8 Claims, 5 Drawing Sheets

DRYING DUCT OF DISHWASHER

BACKGROUND OF THE INVENTION

1. Field of the Invention

The present invention relates to a dishwasher, and more particularly to a drying duct for discharging the hot, humid and pressurized air generated during the drying processes.

2. Description of the Prior Art

Generally, a dishwasher is composed of shelves for fixing up the dishes in the tub, a cleansing motor enabling the cleansing water to be jetted to the dishes, cleansing nozzles jetting the cleansing water to the dishes in various directions and then cleansing the dishes, a blowing fan infusing the outside air into the tub, and an air outlet formed to discharge the hot, humid and pressurized air in the tub out into the outside.

This kind of conventional dishwasher is designed to clean the dishes laid on the shelves with the cleansing water jetted to the dishes in various directions by the cleansing motor and nozzles when the power is applied on the dishwasher with dishes on the shelves.

Furthermore, when the cleaning process is finished in the dishwasher, dishes are dried by a heater and at the same time a blowing fan is operated for improving the drying efficiency, so that outside air is infused into the dishwasher.

However, owing to the outside air being infused into the dishwasher and, the heating temperature being generated during the drying processes of dishes, the infused outside air is combined with humid air produced by the cleansing water inside the dishwasher, which are all thereafter discharged to the outside through the discharge orifice at the same time.

In other words, in order to increase the washing efficiency of dishwasher, the dishes are heated by the heater and simultaneously are jetted with water by the nozzles. And at this moment, hot and humid air fills the inner area of the dishwasher, which increases the pressure inside the tub. Then, the blowing fan is operated to maintain the same pressure in the tub as the atmospheric pressure and simultaneously to increase the drying efficiency, which thereby discharges the hot and humid air out to the outside.

However, as explained above, in order to upgrade the washing efficiency, when the dishes are washed or dried with the hot washing water in a dishwasher, the hot and humid air is discharged to the outside. In this case, the hot and humid air being discharged becomes condensed water due to the temperature difference and flows down along the outside wall of the dishwasher, causing erosions in and outside the dishwasher, or in case the condensed water seeps into the inside of a dishwasher, damage to the inner components and electric leakages can occur.

Furthermore, the hot, humid and pressurized air and condensed water being generated from the dishwasher can create a problem of adversely affecting electric and other surrounding appliances.

In order to solve said problems, many techniques to retrieve the discharging vapor and humidity are known by the artisan, and is represented by Japanese Laid-Open Utility Application No. SHO-57/112765, wherein an exhaust duct discharging the hot and humid air from the inside of dishwasher to the outside is provided, and a dewing apparatus is mounted on said exhaust duct, which retrieves a condensed water portion of the hot humid air being discharged.

Also, Japanese Laid Open Patent Application No. HEI-2/218328 discloses a technique wherein air ventilation routes are formed in various openings installed inside the tub. The vapors in the tub are routed through said air ventilation routes by the blowing fans, by which the vapors are condensed into condensed water and retrieved by way of a heat exchanger in between the waters underneath the lower area of the tub.

However, the former dishwasher (57-112765), being equipped with dewing apparatus at the air outlet of the conventional dishwasher, involves a difficulty in installing the dewing apparatus to the exhaust duct in addition to the inability of completely instantly condensing to condensed water the hot and humid air being discharged to the outside. The latter dishwasher (2-218328) having a closed tub, has to be provided with a separate discharge orifice to maintain the same pressure in the tub as the atmospheric pressure. The latter dishwasher also has the problem of lowered retrieving efficiency of vapor and longer drying time due to hot humid conditions in the tub when the vapor is condensed by a heat exchanger in between air circulating routes and supplied water.

Also, the condensing effect made by the contact with hot humid air circulating through the air circulating routes and the waters supplied to the inner lower area of dishwasher, in the case of the latter dishwasher, deteriorates efficiency-wise as time elapses, or the hot and humid air can not be condensed as the temperature of the water supplied to the dishwasher soars up, which causes the hot and humid air being generated by the dishwasher to be discharged through separate discharge orifice away from the air circulating routes.

SUMMARY OF THE INVENTION

Accordingly, it is an object of the present invention to provide a dishwasher which does not adversely affect the surrounding or peripheral appliances due to the hot, humid and pressurized air being generated from the dishwasher, and at the same time, it is another object of the present invention to prevent damages to the inner and external sides of the dishwasher by way of condensed water produced from the hot, humid and pressurized air in accordance with the operation of the dishwasher.

In order to achieve above objects, the drying duct of a dishwasher according to the present invention is equipped with at least one air discharge outlet near the peripheral surface of one end of the drying duct formed as a flexible hollow tube.

Furthermore the dishwasher in accordance with the present invention is equipped with a tub enabling automatic washing and drying of dishes, and a drying duct which has both ends coupled to the tub, and an air outlet disposed intermediate those ends.

BRIEF DESCRIPTION OF THE DRAWINGS

For better understanding of the nature and objects of the invention, reference should be made to the following detailed description taken in conjunction with the accompanying drawings in which.

DETAILED DESCRIPTION OF PREFERRED EMBODIMENTS OF THE INVENTION

Figures 1, 2:
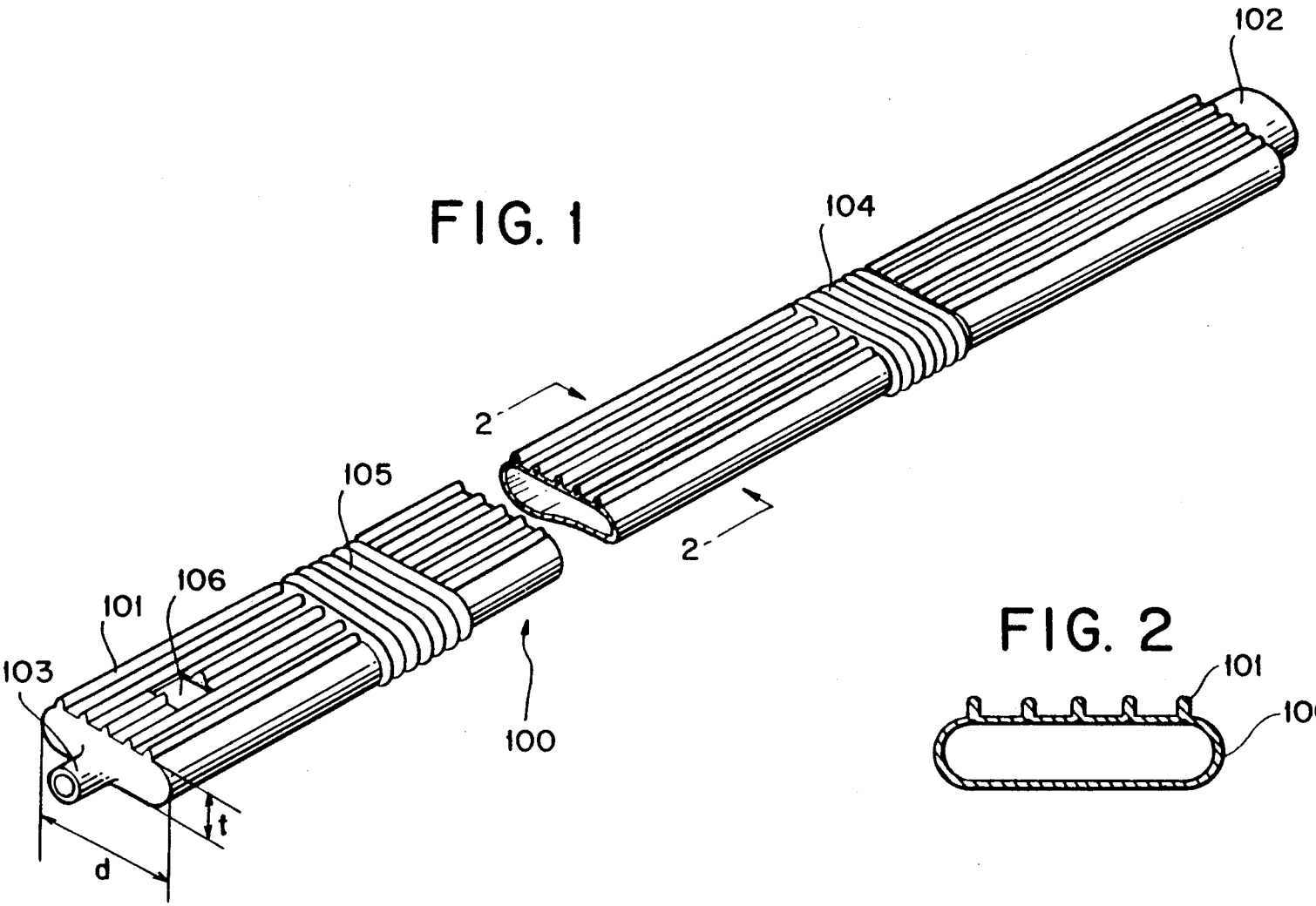
FIG. 1 is a perspective view of a drying duct in accordance with the present invention.
FIG. 2 is a sectional view taken along line 2—2 of FIG. 1.

FIG. 1 is a perspective sectional view to show the construction of a drying duct in accordance with the present invention wherein the drying duct 100 is formed of an oval tube having straight lower and upper surface areas and having a wider width d than the thickness t. The upper surface of the drying duct has plural protruding cooling fins 101. One end of the duct has a first oval coupler 102 whose sectional area is smaller than the drying duct, and the other end has a second small around coupler 103 whose diameter is smaller than the thickness t of the drying duct.

Also, at pre-set positions on the drying duct 100 are formed first and second pleated tubes 104, 105, and in between the second coupler 103 and the first pleated tube 104 the duct 100 is punched to form a dry air discharge outlet 106.

Therefore, in this construction of a drying duct for a dishwasher 100, when hot and humid air is infused into the first coupler 102, the cooling efficiency is increased by the broad cross-sectional area of the drying duct 100 and cooling fins 101. The damp air is cooled changed to condensed water in a very short time, causing cold dry air to be discharged through the dry air discharge outlet 106 and condensed water to be discharged through the second coupler 103.

Meanwhile, because the pleated tubes 104, 105 are easily flexed, the drying duct 100 in accordance with the present invention can be installed onto the dishwasher.

The lower surface of the drying duct 100 is formed flat for tight adherence to the dishwasher. For the increase of cooling efficiency, plural cooling fins 101 are formed on the upper surface of the drying duct.

Figure 3:
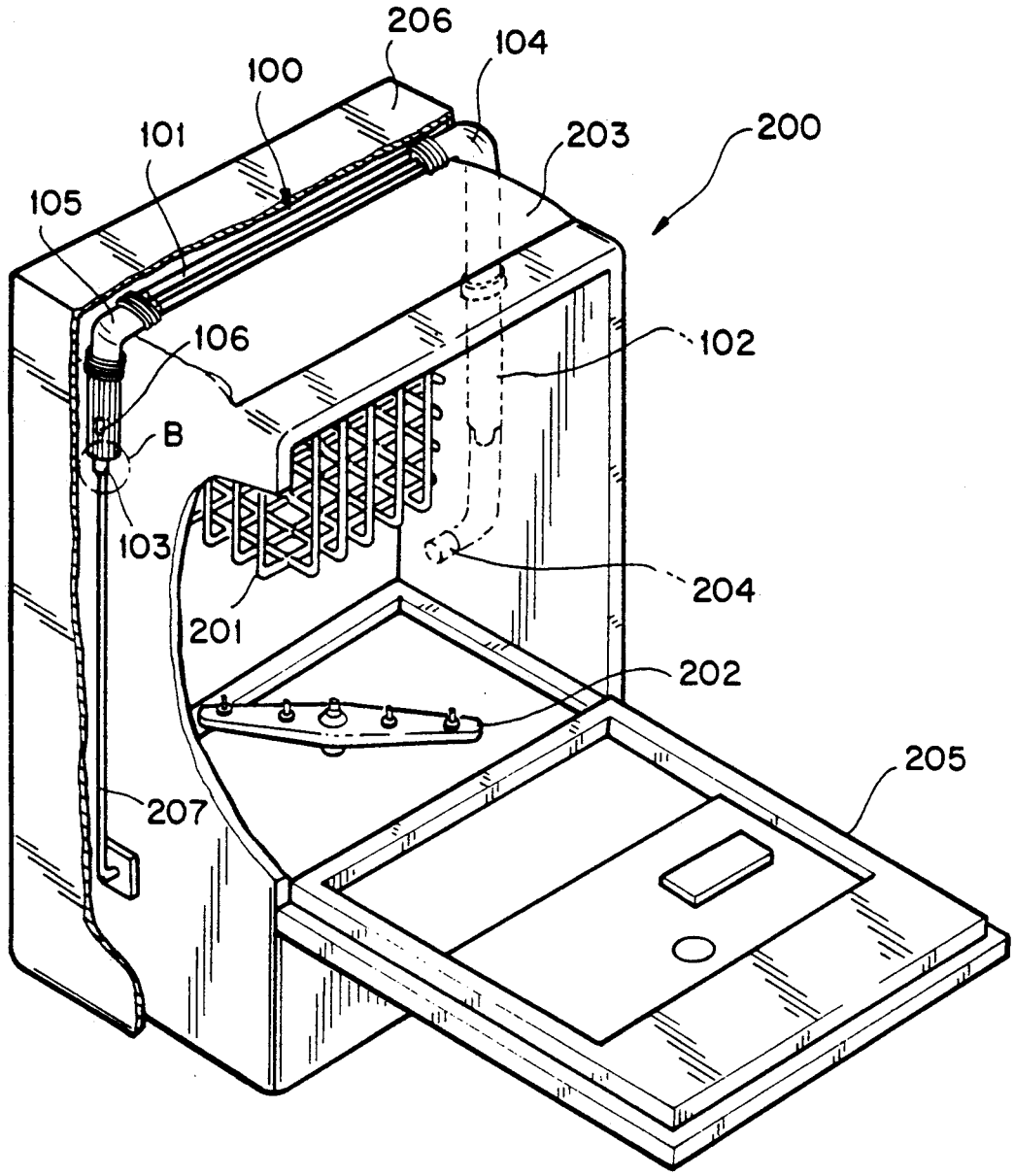
FIG. 3 is a partly broken-away, perspective view of a dishwasher containing the drying duct in accordance with the present invention.

FIG. 3 is a partially-cut sectional view of a dishwasher to show how the drying duct is installed onto the dishwasher with the door of dishwasher opened, wherein the dishwasher 200 is shown to be equipped with shelves 201 for fixing the dishes, cleansing nozzles 202 for jetting the cleansing water, an air discharge outlet 204 installed to be interconnected with the tub 203 for discharge of hot, humid air in the tub 203 to the outside, a door 205, and an external case 206 forming the outer appearance.

The air discharge outlet 204 of the dishwasher 200 is connected to the first coupler 102, and around both curved upper sides of tub 203 the pleated tubes 104, 105, are bent so that the drying duct 100 is installed to bear against the tub 203. The second coupler 103 is connected to a condensed water tube 207 which is connected to an air chamber (not shown) which communicates with the tub along the inner wall of the tub 203.

Here, the cooling fins 101 of the drying duct 100 are, naturally, made to face away from the tub 20, and the dry air discharge outlet 106 faces away from the tub 203.

Accordingly, the hot, damp and pressurized air filled in the tub 203 of dishwasher 200 is cooled and condensed while traveling through the drying duct 100.

Part of the condensate is retrieved by air chamber mounted inside the tub 203 through the second coupler 103 and condensed water tube 207, and part of the condensate infused back into the tub 203 through the first coupler 102 and air discharge outlet 204.

The part of the air from the tub which has been changed to a dry and cool condition is discharged through the discharge outlet 106, causing the pressure in the tub 203 to be the same as the atmospheric pressure.

Figure 4:
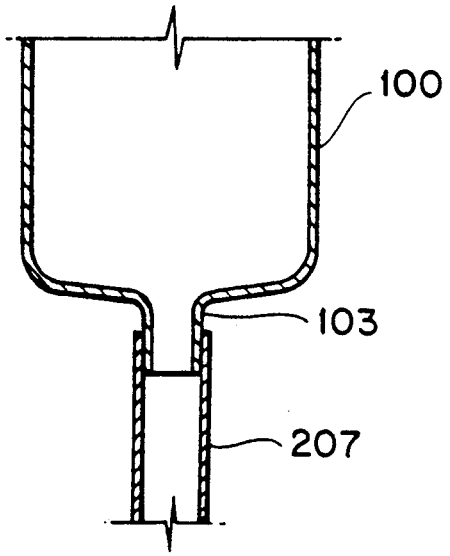
FIG. 4 is a sectional view of the B area in FIG. 3.

FIG. 4 depicts how the second coupler 103 is be inserted into condensed water tube 207 for connection therewith.

That connection can be maintained by the shrinkage tendency of condensed water tube 207, and if necessary, pleats can be formed for increased friction power on the external side of the second coupler 103 and on the inner side of condensed water tube 207, or the connected area between the second coupler 103 and condensed water tube 207 can be clamp by a tightener.

Figure 5:
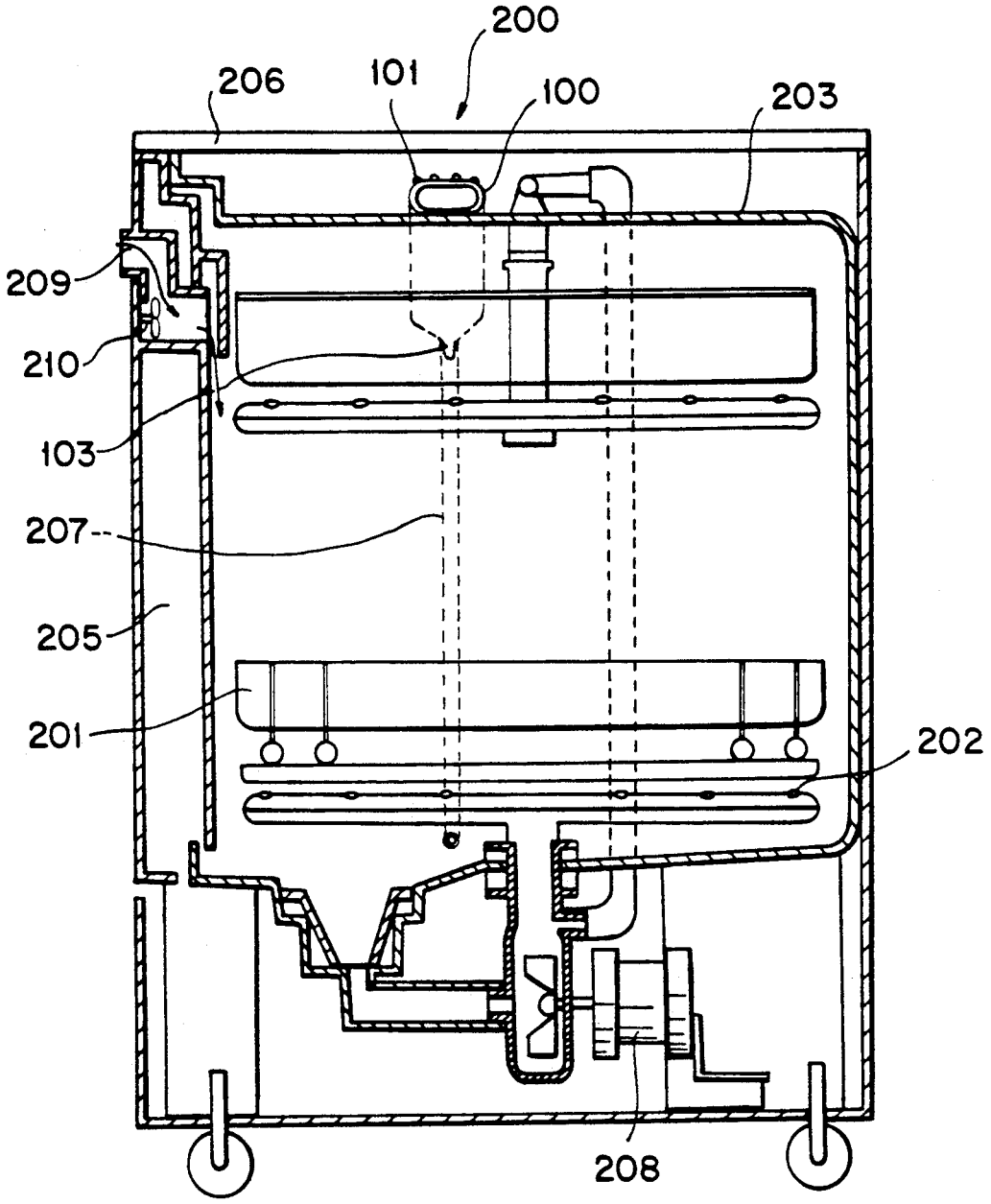
FIG. 5 is a side sectional view of a dishwasher containing a drying duct in accordance with the present invention.

FIG. 5 shows that the dishwasher 200 is composed of shelves 201 for fixing up the dishes in the tub 203, a cleansing motor 208 for generating injection pressure of cleansing water, cleansing nozzles 202 for injecting cleansing water, a blowing fan for infusing the outside air into the tub 203 through the air intake 209, air discharge outlet 204 for discharging hot, humid and pressurized air from tub 203 to the outside, a door 205, and an external case 206 forming the outer appearance.

Therefore, with the drying duct 100 tightly attached to the tub 203 of the dishwasher in accordance with the present invention, the door is opened, dishes to be washed are placed on the shelves 201, and then when dishwasher 200 is operated, injection pressure is produced by cleansing nozzles 208, which then inject cleansing water, which thereby cleans the dishes.

When dish-washing is completed, dishes are dried by the heat of a heater (not shown) and at the same time, outside air is infused into the tub 203 by the blowing fan 210 installed on the inner side of air intake 209. When the outside air is infused into the tub 203, the hot, damp and pressurized air produced during drying processes is discharged through air discharge outlet 204 (refer to FIG. 3), and the discharged hot, damp and pressurized air is cooled while traveling through the drying duct 100 formed with the first coupler 102 and cooling fins (refer to FIG. 3). Part of the cooled and condensed vapor is retrieved into the tub 203 through air discharge outlet 204, and part of the condensed vapor is infused into the air chamber disposed inside the tub 203 through the second coupler 103 and water tube 207.

The dry low-temperature air is discharged through the dry air discharge outlet 106 to drop the pressure in the tub 203, causing the pressure in the tub 203 to be the same as the atmospheric pressure.

Accordingly, due to the atmospheric pressure in the tub during the dish-washing processes, the injected cleansing water can be jetted out powerfully, so that a reduction in washing efficiency can be prevented.

Figure 6:
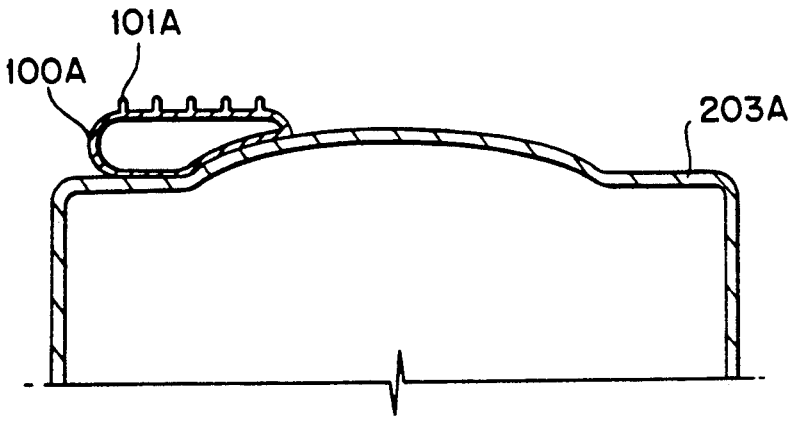
FIG. 6 is a sectional view illustrating a drying duct installed in a tub in accordance with another embodiment of the present invention.

FIG. 6 is a sectional view of another embodiment having a modified drying duct 100A which is closely attached to the tub 203A when the center of the tub 203A is protruded and expanded along the top surface.

This tub construction is so made to have an oval-shaped top center protrusion that the condensed water cooled and formed in the inner upper side of the tub 203A from the hot, damp air can be easily dripped.

As explained above, in the case of the protruded oval-shaped top center of tub 203A, one lower end of the drying duct 100A is caused to have a curved form, so that the outside surface of oval-shaped protruded tub 203A can be tightly engaged to the lower surface of the drying duct 100A.

This kind of curved inner surface at one end of the drying duct can easily retrieve the condensed water condensed from the drying duct 100A, resulting in increased drying efficiency, as in the case of the oval-shaped tub 203A for easy dripping of the condensed water.

Figure 7:
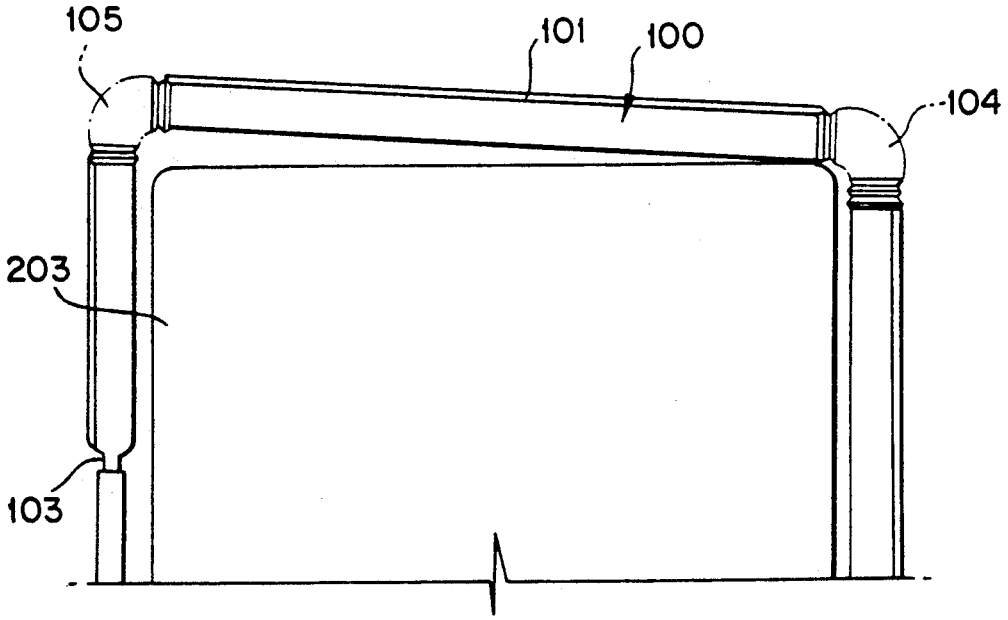
FIG. 7 is an elevational view of a drying duct installed slantingly on the tub.

FIG. 7 depicts a drawing illustrating the drying duct mounted slantingly on the tub in accordance with the present invention.

According to FIG. 7, the first pleated tube 104 of drying duct 100 and the top corner of one end of the tub 203 are constructed to be tightly adhered, and the drying duct 100 is so constructed that the second pleated tube 105 is spaced above the upper surface of the tub 203.

Accordingly, the cooled condensed water formed in between the second pleated tube 105 of drying duct 100 and the first coupler is, as explained above, infused into the tub 203 along the slope and then through the first pleated tube 104 en route to the first coupler and air discharge outlet.

The cooled condensed water formed in between the second pleated tube 105 and the second coupler 103 is infused into the air chamber of the tub 203 through condensed water tube 207.

As from the foregoing description, the drying duct of dishwasher in accordance with the present invention should be formed in oval shape and with cooling fins mounted for increased cooling efficiency.

Furthermore, the pleated tube is formed on the corner area of the tub and a coupler is formed on one end of the drying duct for connection to an air discharge outlet while on the other end of the drying duct, a tubular coupler with smaller diameter is formed to connect to a condensed water tube for the purpose of easy installation.

Also, an air discharge outlet is formed in the tube on the side thereof opposite the air discharge orifice and at the same time, the place where the air discharge outlet is located is higher, so that only dry air devoid of dampness is discharged, resulting in prevention of damage to any nearby electric appliances.

The foregoing description of the preferred embodiment has been presented for the purpose of illustration and description.

It is not intended to limit the scope of this invention but it should be noted that the present invention can be applied to many modifications and variations within the scope of the present invention, and more particularly, in the above explanation, two pleated tubes are formed however the number of the pleated tubes can be increased or reduced according to the place where the drying duct is installed.

Also it should be noted that the drying duct of a dishwasher according to the present invention need not be limited to a particular embodiment but can be with other drying apparatus.

What is claimed is:

1. A dishwasher apparatus, comprising:

a dishwashing unit including means for receiving dishes to be washed, means for jetting wash water against the dishes, and means for supplying heating air to dry the dishes, and an air duct for conducting hot moist air from said dishwashing unit, said air duct including a flexible hollow tubing having first and second open ends connected to said dishwashing unit, cooling fins disposed on a side of said tubing and an air outlet disposed intermediate said first and second ends, wherein said first and second ends of said air duct communicate with said dish receiving means to conduct thereto water which has condensed in said air duct, while hot air is discharged through said air outlet.

2. A dishwasher apparatus according to claim 1, wherein said air duct is of oblong cross-section.

3. A dishwasher apparatus according to claim 1, wherein said air duct includes a plurality of pleated sections to facilitate bending of said air duct around corners of said dishwashing unit.

4. A dishwasher apparatus comprising:

a dishwashing unit including means for receiving dishes to be washed, means for jetting wash water against the dishes, and means for supplying heating air to dry the dishes, and an air duct for conducting hot moist air from said dishwashing unit, said air duct including a flexible hollow tubing having first and second open ends connected to said dishwashing unit, cooling fins on a side of said tubing, and an air outlet disposed intermediate said first and second ends, wherein said dishwashing unit includes an outer housing, said tubing including a first side bearing against said dishwashing unit and a second side facing away from said outer housing, said second side including said cooling fins.

5. A dishwasher apparatus according to claim 4, wherein said air duct is of oblong cross-section.

6. A dishwasher apparatus comprising:

a dishwashing unit including means for receiving dishes to be washed, means for jetting wash water against the dishes, and means for supplying heating air to dry the dishes, and an air duct for conducting hot moist air from said dishwashing unit, said air duct including a flexible hollow tubing having first and second open ends connected to said dishwashing unit, cooling fins on a side of said tubing, and an air outlet disposed intermediate said first and second ends, wherein said dishwashing unit comprises an outer housing, said tubing comprising a plurality of pleated sections bent around corners of said outer housing.

7. A dishwasher apparatus according to claim 1 wherein said cooling fins are disposed on a top surface of said tubing.

8. A dishwasher apparatus according to claim 1 wherein said cooling fins are oriented so as to extend parallel to a direction of fluid flow through said tubing.

* * * * *